US008360245B2

(12) United States Patent
Niitti

(10) Patent No.: US 8,360,245 B2
(45) Date of Patent: Jan. 29, 2013

(54) EQUIPMENT AND METHOD FOR FLOTATING AND CLASSIFYING MINERAL SLURRY

(75) Inventor: Timo Niitti, Kuopio (FI)

(73) Assignee: Outotec Oyj, Espoo (FI)

( * ) Notice: Subject to any disclaimer, the term of this patent is extended or adjusted under 35 U.S.C. 154(b) by 823 days.

(21) Appl. No.: 12/439,241

(22) PCT Filed: Aug. 30, 2007

(86) PCT No.: PCT/FI2007/000213

§ 371 (c)(1),
(2), (4) Date: Jul. 28, 2009

(87) PCT Pub. No.: WO2008/025871

PCT Pub. Date: Mar. 6, 2008

(65) Prior Publication Data

US 2010/0018907 A1 Jan. 28, 2010

(30) Foreign Application Priority Data

Aug. 30, 2006 (FI) ..... 20060780

(51) Int. Cl.
*B03D 1/14* (2006.01)
*B03D 1/16* (2006.01)
*B03B 7/00* (2006.01)

(52) U.S. Cl. ..... 209/164; 209/12.1; 209/18; 209/168; 209/169

(58) Field of Classification Search ..... 209/164, 209/168, 169, 12.1, 18
See application file for complete search history.

(56) References Cited

U.S. PATENT DOCUMENTS 5,472,094 A * 12/1995 Szymocha et al. ..... 209/169
5,601,703 A * 2/1997 Szymocha et al. ..... 209/164
5,909,022 A 6/1999 Bourke et al.
5,923,012 A 7/1999 Bourke et al.
2006/0219603 A1 10/2006 Bourke

FOREIGN PATENT DOCUMENTS

GB 537401 7/1939
GB 2266479 A 11/1993
WO WO2006/095044 A1 * 9/2006

* cited by examiner

*Primary Examiner* — Thomas M Lithgow
(74) *Attorney, Agent, or Firm* — Chernoff Vilhauer McClung Stenzel LLP

(57) ABSTRACT

The invention relates to an equipment and method for flotating mineral slurry (4) in a flotation cell provided with a flotation mechanism (3), comprising at least a drive shaft (6), a rotor (5) and a stator (7), and at least one inlet (11) for feeding mineral slurry (4), a froth launder system (8) for removing mineral enriched froth, at least two discharge outlets (28, 12) for removing two material flows with two different grain sizes from the flotation cell, in which case the flotation cell (2) is provided with a classifying equipment (1) including means for setting the mineral slurry (24) to be classified, separated from the mineral slurry, in an essentially upwardly moving rotary motion in the flotation cell, as well as means for separating coarser material (25) from finely divided material (26).

28 Claims, 2 Drawing Sheets

EQUIPMENT AND METHOD FOR FLOTATING AND CLASSIFYING MINERAL SLURRY

Figure 2:
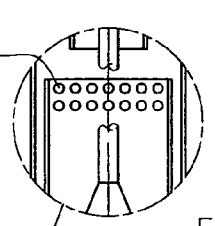

The invention relates to an equipment and method for flotating mineral slurry (slimes). According to the invention, from part of the mineral slurry (slimes) fed into the flotation cell, the coarse and fine material are separated inside the flotation cell for separate treatments.

Conventional flotation devices include a tank for receiving the slurry (slimes) obtained from a grinder, a cyclone separator or some other corresponding device. Generally the tank is provided with an agitator comprising a rotor placed inside the stator, which agitator is activated by a motor and a drive shaft for agitating the slurry (slimes). The device also includes an aeration system for conducting pressurized air into the agitator through a central conduit formed inside the drive shaft. Suitable reagents are also added; they coat the surface of the selected mineral particles in the slurry (slimes) and make the particles water-repellent, thus advantageously helping the bubbles to be attached to the selected particles. When the bubbles broken by the rotor rise towards the tank surface, they carry said selected mineral particles that form a mineral enriched surface froth. Then the froth proceeds over the froth lip of the vessel to a launder, whereafter the mineral particles suspended in the froth are recovered from the tank as a mineral concentrate. Those mineral particles that are left suspended in the slurry (slimes) and not removed as a concentrate in the flotation process are continuously discharged from the tank through a bottom outlet.

The slurry (slimes) discharged through the bottom outlet contains both relatively coarse or dense particles and a large amount of relatively fine particles, including slurries, such as clay minerals, that are not discharged in flotation. The slurries are composed of very fine particles, and thus their total surface area is much larger than that of coarse particles. Consequently, when flotation reagents are added in the slurry (slimes), the majority of them tends to be absorbed in the fine particle share of the particle distribution. The majority of the flotation reagent tends to be absorbed in the slurries, which makes the flotation process nonselective. Thus the majority of the coarsest valuable particles does not, even with extended processing time, receive sufficiently flotation reagent in order to make them water-repellent. It is generally known that a flotation process can be boosted, if coarse and fine particles are treated separately. Separate classifying devices, such as hydrocyclones and hydroclassifiers, have been used for separating flotation feed flow into two separate flows, to be separately processed. However, the capital costs of this kind of equipment are high, which makes prior art methods uneconomical with all but the most valuable ore types.

From the publication U.S. Pat. No. 5,909,022, there is known a flotation equipment for separating minerals inside the flotation cell, said cell being provided with separate outlets both in the top and bottom parts of the cell, both for coarse and fine material. In connection with said outlets, there are arranged valves for controlling the removal of the slurry (slimes) material. However, by using said equipment, there is not achieved an equally effective way for separating coarse and fine mineral substances as by using the arrangement of the present invention.

According to the present invention, a slurry (slimes) flow containing both fine and coarse particles can be progressively separated into two separate flows in the flotation cell. One flow contains relatively coarse particles, and the other flow contains finer particles. In this way, said two flows can be optimized separately for the processing of either coarse or fine particles, which gives the best possible efficiency and cost-effectivity for the whole separation process. Thus it should be understood that the invention brings forth remarkable advantages, both practical and economical, in comparison with the prior art.

The purpose of an arrangement according to the invention is to introduce a novel method and equipment for flotating mineral slurry (slimes), wherein fine and coarse ingredients are mutually separated, i.e. classified, inside the flotation cell.

The characteristic novel features of the invention are apparent from the appended claims. The invention relates to an equipment for flotating mineral slurry (slimes) in a flotation cell provided with a flotation mechanism comprising at least a drive shaft, a rotor and a stator, and at least one inlet for feeding mineral slurry (slimes), a froth launder system for removing mineral enriched froth, at least two discharge outlets for removing material flows with two different grain sizes from the flotation cell, in which case the flotation cell is provided with classifying equipment including means for setting the mineral slurry (slimes) to be classified, separated from the mineral slurry (slimes), in an essentially upwardly proceeding rotary motion in the flotation cell, as well as means for separating coarser material from finely divided material. When being set in a rotary motion, coarse material is separated from finely divided material owing to the effect of centrifugal force. According to a preferred embodiment of the invention, the classifying equipment is arranged around the drive shaft, in which case it utilizes the rotary force of the drive shaft of the flotation cell. According to an embodiment of the invention, the classifying equipment includes at least a classifying element provided with an overflow space for finely divided material and a classifying space for separating fine and coarse material. When the feed slurry (slimes) is conducted to the flotation cell, part of it is separated as mineral slurry (slimes) to be classified and is conducted to the classifying equipment arranged around the drive shaft, and in between the classifying space of the provided classifying element and the overflow space, there is arranged an aperture for removing finely divided material from the classifying space. By adjusting the size of the above mentioned aperture, the circulation and grain size of the finely divided material can be controlled.

According to an embodiment, the classifying element extends, at the bottom part of the flotation cell, to the vicinity of the rotor, to a desired distance therefrom, and at the top part nearly as high as the height of the froth launder system. Thus the finely divided mineral substance can be removed from the flotation cell through the top part thereof.

According to an embodiment of the invention, the classifying space of the classifying element includes a separator element extending around the drive shaft, which separator element extends to at least part of the height of the classifying element. According to an embodiment, the separator element is rotary owing to the effect of the drive shaft, in order to set the mineral slurry (slimes) to be classified in rotary motion. In connection with the separator element, there is provided at least one pumping element for enhancing the feeding of the mineral slurry (slimes) to be classified into the classifying space. In addition, the classifying space is provided with at least one orientation element for conducting the material flow to be classified away from the drive shaft, which orientation element extends around the drive shaft. Thus the desired mineral substance to be separated is conducted to the area of the higher centrifugal force, and the separation of the coarser material is improved. According to the characteristic features of the invention, in the space arranged in between the separator element and the classifying element, there is provided at least one circulation duct for removing coarser material into the flotation cell. After being discharged from the classifying equipment, the coarser material is further mixed in the flotation cell circulations. According to an embodiment of the invention, the separator element is provided with outlets for removing coarser material. This enhances the removal of the coarser material from the separator element through the outlets to the circulation duct, in addition to the fact that part of the coarser material is discharged as overflow.

According to the invention, the overflow space of the classifying element includes at least one outlet for finely divided material and at least one outlet in the classification device for removing possibly flotated material and air, for instance to be mixed in the rest of the concentrate. According to an embodiment of the invention, the space between the rotor of the flotation mechanism and the classifying equipment is provided with turbulent flow prevention elements, by means of which only the flowing of the mineral slurry (slimes) to be classified into the classifying equipment is enhanced.

According to the invention, in connection with the separator element, there also are arranged pumping means for enhancing the removal of coarser material from the classifying space.

According to the invention, in between the finely divided material discharge outlet provided in the flotation cell wall and the overflow space discharge outlet, there is arranged at least one channel. According to the invention, in the vicinity of the discharge outlet for finely divided material, there is arranged at least one valve for adjusting the discharge flow of finely divided material. According to a preferred embodiment of the invention, the diameter of the classifying element is essentially equal to the diameter of the flotation mechanism rotor.

According to the invention, the finely divided material removed from the flotation cell is further processed in flotation for example in another flotation equipment optimized for finely divided material, or processed further in some other way. The classified coarse material is fed to be further flotated or treated otherwise in a specific optimized process. Because the flotation process is generally performed in a row of several flotation cells, it is obvious that the classifying equipment according to the present invention can be installed in several successive flotation cells, which improves classification efficiency.

DRAWINGS

Figure 1:
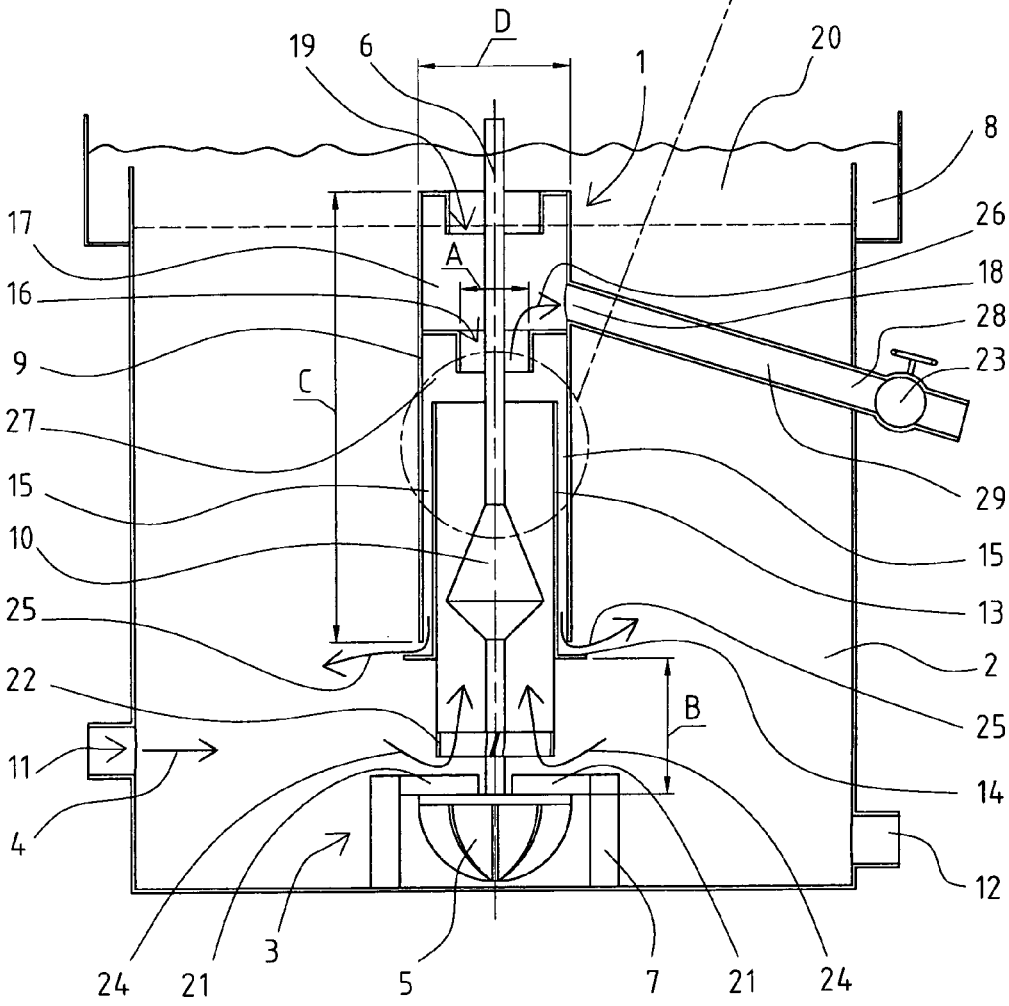
Figure 3:
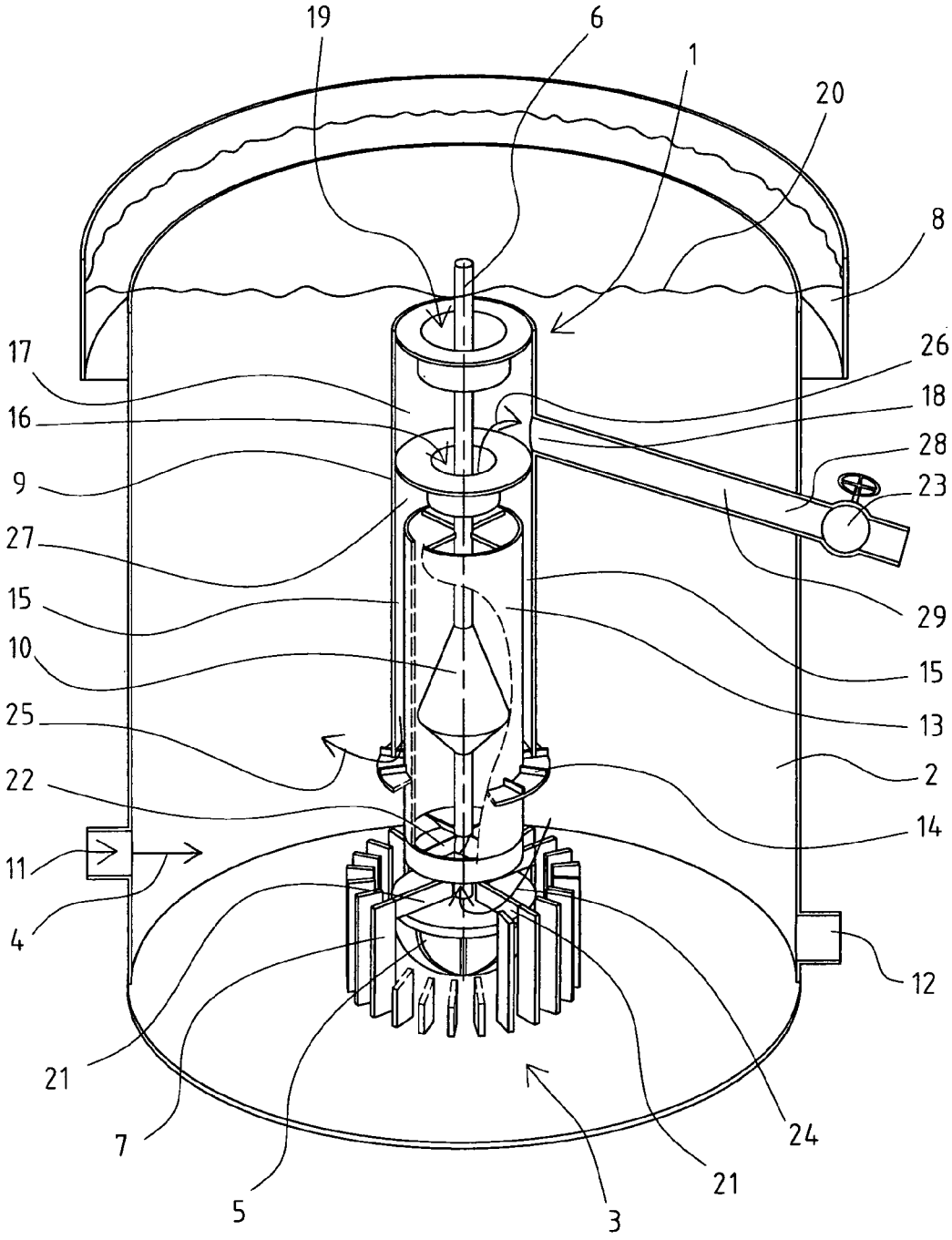

The equipment according to the invention is further described with reference to the accompanying drawings, where FIG. 1 is a side-view illustration of an equipment according to the invention FIG. 2 is an illustration of an equipment according to an embodiment FIG. 3 is a 3d-view illustration of the equipment according to the invention.

The equipment according to the invention for flotating mineral slurry (slimes) is illustrated in FIGS. 1, 2 and 3. According to the example, a cylindrical flotation cell 2 comprises a flotation mechanism 3 that agitates the feed slurry (slimes) 4 and sets it in rotary motion due to the influence of the rotary motion of the drive shaft 6. The flotation mechanism 3 includes a rotor 5 that is installed in the centrally arranged drive shaft 6, which extends in parallel with said shaft down to the flotation cell, said drive shaft being driven by a motor. Around the rotor, there also is provided a stator 7. As is illustrated in the drawings, the rotor 5 is located near the bottom of the flotation cell 2. Air is fed in the flotation mechanism 3 through a hollow axis that is arranged to rotate the rotor 5, or through a gas inlet that is arranged underneath the flotation mechanism. The mineral slurry (slimes) 4 to be supplied in the process is conducted in the flotation cell 2 through an inlet 11, which inlet is generally formed in the side wall of the flotation cell 2. The feed slurry (slimes) can also be brought in the flotation cell for example through a pipe from the top part of the cell. During flotation, the feed slurry (slimes) 4 is transferred through the stator 7 to the rotor and mixed with air, whereafter it proceeds back to the cell space and further upwardly in the cell along with the bubbles, thus carrying mineral enriched ingredients along, part of which ingredients are separated to mineral slurry (slimes) 24 to be classified. Around the inner top part of the side wall of the flotation cell 2, there extends a froth launder system 8, from which the mineral enriched froth 20 that has risen to the surface is removed.

According to the invention, from the mineral slurry (slimes) 4 flotated in the flotation cell 2, part is separated to mineral slurry (slimes) 24 to be classified, in which case the coarse and fine ingredients contained in the slurry (slimes) 24 to be classified are separated by means of the classifying equipment 1 installed in the flotation cell. There is thus separated a separate outflow 18 for the finely divided ingredients 26, which outflow can be treated separately. According to the invention, the classifying equipment 1 comprises a stationary cylindrical classifying element 9 installed around the rotary drive shaft 6 of the flotation cell 2, which classifying element defines a separate classifying space 27 for separating coarse and fine ingredients, i.e. for classification, and an overflow space 17 into which the finely divided material 26 as well as air and concentrate are removed from the classifying space. Advantageously the overflow space 17 is located above the classifying space 27 in the flotation cell. The classifying element 9 is attached for example to the structures of the flotation cell 2, so that both the classifying element 9, the classifying space 27 and the overflow space 17 are located symmetrically around the drive shaft 6. The classifying element 9 includes an essentially cylindrical side wall that at the bottom part extends to the vicinity of the rotor 5, to a distance B therefrom, and at the top part essentially as high as the height of the froth launder system 8. The diameter D of the classifying element 9 is proportioned with the diameter of the flotation cell, and it is advantageously of the same order as the diameter of the rotor 5 of the agitator. According to the invention, the rotary force for the mineral slurry (slimes) to be classified is obtained from the drive shaft 6.

In the flotation cell, the mineral slurry (slimes) 24 to be classified is by means of hydrostatic pressure set in an essentially upwardly flowing and rotary motion inside the classifying element 9, in the classifying space 27. The classifying space 27 includes a cylindrical separator element 13 that is rotary owing to the effect of the drive shaft 6 and extends to part of the height of the classifying element 9, inside which element 13 coarse material 25 is separated from finely divided material 26 due to centrifugal force and gravity. In order to make the upwardly moving rotary motion for the slurry (slimes) 24 to be classified possible, in between the rotor 5 of the flotation mechanism 3 and the classifying element 9, there are installed turbulent flow prevention elements 21, advantageously four or more in number. Consequently, from the rotor 5, the mineral substance further proceeds to other material flows of the flotation cell that flow upwardly in the cell, and the mineral slurry (slimes) 24 to be classified can flow upwardly in the classifying equipment 1. Coarse ingredients are separated from fine ingredients in the classifying space 27, from where they are removed from inside the separator element 13 owing to the effect of the centrifugal force causing rotary motion, mainly as an overflow. Inside the separator element 13, the flowing of the mineral slurry (slimes) 24 to be classified is controlled by means of an orientation element 10. The orientation element 10 is designed so that inside the separator element 13, the coarse material proceeds towards its edges, away from the vicinity of the drive shaft 6, to the area of a higher centrifugal force. Thus the circulation is made optimal, and the coarse material flows towards the edges as soon as possible after entering the classifying equipment 1, and at the same time it flows upwardly, until it is separated as an overflow from the separator element. In addition, coarse material is separated as the slurry (slimes) to be classified is further transported upwardly in the classifying space 27 of the classifying element 9 as rotary motion prevails, until the finely divided material 26 is separated therefrom into a separate overflow space 17 through an outlet 16 arranged in the classifying element 9. The coarse material 25 separated in classification is separated owing to centrifugal force, and it is conducted out of the classifying element for instance through at least one circulation duct 15 provided between the separator element 13 and the classifying element 9; when being discharged from said duct, the coarse slurry (slimes) is further mixed in the circulations of the flotation cell 2. According to an example of the invention, the separator element 13 is attached to the drive shaft 6. The wall of the separator element 13 can also be provided with outlets 30 for conducting the coarse material further to the circulation duct 15, as is illustrated in the embodiment according to FIG. 2. The upwardly proceeding circulation and rotary motion of the slurry (slimes) are enhanced by means of a pumping element 22, such as a propeller, placed underneath the classifying element 9. In connection with the circulation duct 15, the separator element 13 is provided with pumping means, such as blades 14, which blades, when rotating, enhance the flowing of the coarse material out of the classifying space 27 of the classifying element 9 along the circulation duct 15 to the flotation cell. Coarse mineral material is transferred to the flotation cell to be flotated further, and it sticks to the bubbles thus forming mineral froth, but part of it is removed to separate processing through a bottom discharge outlet 12 arranged in the bottom part of the flotation cell.

The circulation of the fine material and the grain size of the solid substance contained in the slurry (slimes) are adjusted by altering the diameter A of the outlet 16. The overflow space 17 includes a discharge outlet 18 for the finely divided material 26, which is further conducted, along the channel 29, to the discharge outlet 28 arranged in the wall of the flotation cell 2. In the vicinity of the discharge outlet 28 for finely divided material, there is connected a valve 23 for adjusting the quantity of the outflowing material. The overflow space 17 also includes a discharge outlet 19 for air and possible concentrate that is mixed in the froth layer 20 of the flotation cell. The finely divided material flow 26 to be discharged through the discharge outlet 28 and the coarse material flow to be discharged through the bottom discharge outlet 12 are further fed to be flotated in separate flotation circuits, or to be otherwise treated in separate processes. The diameter A of the outlet 16, the diameter of the discharge outlet 19 and the distance B between the bottom edge of the classifying element 9 and the agitator are selected individually for each case, according to the process conditions.

The invention is further described with reference to the following example.

EXAMPLE 1

The example describes a method according to the invention for flotating mineral slurry (slimes), in which method fine and coarse material are separated inside the flotation cell for individual further processes. In the flotation cell, there is fed feed material, where 56.4% of the solid substance contained therein has a grain size larger than 210 μm, and 9.7% has a grain size smaller than 37 μm. Said feed material is classified by means of classifying equipment arranged inside the flotation cell, so that fine and coarse materials are separated. Of the finely divided material obtained from classification, 12.0% has a grain size larger than 210 μm and 22.9% has a grain size smaller than 37 μm. As regards the solid substance contained in the coarse waste that is simultaneously removed from the flotation cell, 69.3% has a grain size larger than 210 μm, and 5.3% has a grain size smaller than 37 μm. By applying the classification according to the invention, the majority of the finely divided material is separated from the coarse material. According to the example, even 59% of the finest material is separated in the fine product, and 77.5% of the coarse material is separated in the coarse product, which illustrates the useful nature of the present invention.

The invention is not restricted to the above described embodiments only, but many modifications and combinations thereof are possible within the scope of the inventive idea manifested in the appended claims.

The invention claimed is:

1. Apparatus for flotating mineral slurry, the apparatus comprising:

a flotation cell having at least one inlet for feeding mineral slurry into the flotation cell and at least first and second discharge outlets for discharging material flows from the flotation cell, a flotation mechanism including at least a drive shaft, a rotor and a stator, a froth launder system for removing mineral enriched froth, a classifying equipment located above the rotor for receiving a portion of mineral slurry flotated by the flotation mechanism, the classifying equipment including a means for imparting an upward rotary movement to the received portion of the flotated mineral slurry and a means for separating coarser material contained in the received portion of the flotated mineral slurry from finely divided material contained in the received portion of the flotated mineral slurry, and wherein the first discharge outlet is positioned for discharging the finely divided material and the second discharge outlet is positioned for discharging the coarser material.

2. Apparatus according to claim 1, wherein the classifying equipment defines a classifying space and the drive shaft extends through the classifying space.

3. Apparatus according to claim 1, wherein the classifying equipment includes at least a classifying element that defines a classifying space in which finely divided material and coarser material are separated, in use, and an overflow space that receives the finely divided material from the classifying space.

4. Apparatus according to claim 3, comprising at least one duct between the classifying space of the classifying element and the overflow space for discharging finely divided material from the classifying space.

5. Apparatus according to claim 3, wherein the classifying element extends upward from a level in the vicinity of the rotor and spaced upward from the rotor to a level nearly as high as the froth launder system.

6. Apparatus according to claim 3, comprising a separator element disposed in the classifying space of the classifying element and extending around the drive shaft, which separator element extends over at least part of the height of the classifying element.

7. Apparatus according to claim 6, wherein the separator element is coupled to the drive shaft for rotation therewith in order to impart rotary motion to the mineral slurry to be classified.

8. Apparatus according to claim 6, comprising at least one pumping element conneced to the separator element for enhancing feeding of the mineral slurry to be classified into the classifying space.

9. Apparatus according to claim 6, wherein the classifying element divides the flotation cell into an interior space and an exterior space and the separator element is spaced from the classifying element to provide at least one circulation duct for discharging coarser material to the exterior space of the flotation cell.

10. Apparatus according to claim 6, wherein the separator element is formed with outlets for discharging coarser material from the classifying space.

11. Apparatus according to claim 6, comprising pumping elements connected to the separator element for enhancing discharge of coarser material from the classifying space.

12. Apparatus according to claim 3, comprising at least one orientation element disposed in the classifying space for conducting the material flow to be classified away from the drive shaft.

13. Apparatus according to claim 12, wherein the orientation element extends around the drive shaft.

14. Apparatus according to claim 3, wherein the overflow space of the classifying element has at least one discharge outlet for removing finely divided material and at least one outlet for removing air and flotated material.

15. Apparatus according to claim 3, wherein the first discharge outlet is an outlet of the overflow space and at least one channel extends from the first discharge outlet through a wall of the flotation cell.

16. Apparatus according to claim 15, comprising at least one valve for adjusting flow of the finely divided material through the channel.

17. Apparatus according to claim 3, wherein the classifying element is substantially equal in diameter to the rotor of the flotation mechanism.

18. Apparatus according to claim 1, comprising turbulent flow prevention elements between the rotor of the flotation mechanism and the classifying equipment.

19. A method for flotating mineral slurry, comprising:

feeding mineral slurry into a flotation cell through at least one inlet, aerating and agitating slurry in the flotation cell by means of a flotation mechanism comprising at least a drive shaft, a rotor, and a stator, removing mineral enriched froth from the flotation cell through a froth launder system, receiving a portion of the mineral slurry flotated by the flotation mechanism at a classifying equipment arranged in the flotation cell above the rotor, imparting upward rotary motion to the received portion of the mineral slurry, separating coarser material contained in the received portion from finely divided material contained in the received portion, and separately discharging at least two slurry flows with different average grain sizes from the flotation cell.

20. A method according to claim 19, comprising separating the finely divided material and the coarse material in the vicinity of the drive shaft.

21. A method according to claim 19, comprising conducting mineral slurry to be classified to a classifying space of a classifying element included in the classifying equipment, in which classifying space the finely divided material and the coarse material are separated, and conducting finely divided material from the classifying space to an overflow space of the classifying element.

22. A method according to claim 21, comprising controlling the flow and grain size of the finely divided material by adjusting the size of a duct between the classifying space and the overflow space.

23. A method according to claim 21, comprising enhancing discharge of the coarse material from the classifying space by pumping.

24. A method according to claim 19, comprising enhancing upward rotary movement of the mineral slurry to be classified by pumping.

25. A method according to claim 19, comprising conducting flow of the mineral slurry to be classified away from the drive shaft by means of at least one orientation element.

26. A method according to claim 19, comprising further treating the finely divided material by flotation.

27. A method according to claim 19, comprising further treating the coarse material by flotation.

28. A method according to claim 19, comprising flotating the mineral slurry in several successive flotation cells, at least some of which are provided with classifying equipment.

* * * * *